US008100656B2

(12) United States Patent
Kellermann et al.

(10) Patent No.: US 8,100,656 B2
(45) Date of Patent: Jan. 24, 2012

(54) FAN APPARATUS FOR A COOKING DEVICE

(75) Inventors: Peter Kellermann, Burghausen (DE); Markus-Günter Lohr, Siegsdorf (DE); Peter Mallinger, Traunreut (DE); Achim Steinbrügge, Bünde (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1035 days.

(21) Appl. No.: 11/989,456

(22) PCT Filed: Jun. 27, 2006

(86) PCT No.: PCT/EP2006/063606

§ 371 (c)(1),
(2), (4) Date: Jan. 25, 2008

(87) PCT Pub. No.: WO2007/012535

PCT Pub. Date: Feb. 1, 2007

(65) Prior Publication Data

US 2009/0104037 A1 Apr. 23, 2009

(30) Foreign Application Priority Data

Jul. 28, 2005 (DE) ..... 10 2005 035 462

(51) Int. Cl.
*F04D 29/34* (2006.01)

(52) U.S. Cl. ..... 416/204 R; 416/244 R

(58) Field of Classification Search ..... 416/204 R, 416/244 R; 403/368, 369, 370
See application file for complete search history.

(56) References Cited

U.S. PATENT DOCUMENTS

| | | | | |
|---|---|---|---|---|
| 3,021,049 | A * | 2/1962 | Settle | 416/185 |
| 6,305,906 | B1 | 10/2001 | Ekstrom | |
| 2005/0287006 | A1 * | 12/2005 | Roso et al. | 416/244 R |

FOREIGN PATENT DOCUMENTS

| | | |
|---|---|---|
| DE | 444 597 | 5/1927 |
| DE | 509 460 | 10/1930 |
| DE | 40 23 874 | 2/1992 |
| EP | 0 468 147 | 1/1992 |
| FR | 1 129 253 | 1/1957 |
| FR | 2 816 379 | 5/2002 |

OTHER PUBLICATIONS

International Search Report PCT/EP2006/063606.

* cited by examiner

*Primary Examiner* — Edward Look
*Assistant Examiner* — Dwayne J White
(74) *Attorney, Agent, or Firm* — James E. Howard; Andre Pallapies

(57) ABSTRACT

A fan apparatus for a cooking device is provided having a fan impeller that is held on a drive shaft of a rotary drive by its hub and is pressed against a stop of the drive shaft in an axial direction by a screw nut. In order to ensure that the fan impeller is securely held on the drive shaft, the screw nut exerts a pressing force on the fan impeller in a radial direction.

19 Claims, 3 Drawing Sheets

FAN APPARATUS FOR A COOKING DEVICE

The present invention relates to a fan apparatus for a cooking device, having a fan impeller, which is held on a drive shaft of a rotary drive by means of its hub and is pressed against a stop of the drive shaft in an axial direction by a screw nut.

BACKGROUND

A fan apparatus of this type is known sufficiently from the prior art. This fan apparatus is used to distribute heat equally in particular in a cooking chamber of a cooking device, by cooking food. The rotary drive of the fan apparatus can include an electric motor for instance, with which the fan apparatus can be driven. Fan apparatuses of this type must be reliable since these are difficult to assemble and dismantle by virtue of their restricted accessibility in the installed state.

SUMMARY

The object underlying the present invention is to propose a fan apparatus of the type mentioned in the introduction, in which the fan impeller is securely fastened to the drive shaft of the fan apparatus.

In the case of a fan apparatus, the fan impeller is fastened to a drive shaft of a rotary drive with its hub by means of a nut which can be screwed onto a thread at the free end of the drive shaft. In addition, provision can be made for at least one surface segment to be provided on the hub and at least one corresponding inner surface segment on the nut, so that the inner surface segment can be deformed against the surface segment of the hub as the nut is being screwed on. As a result, the screw nut is able to not only exert a compressive force on the impeller wheel in an axial direction of the rotary axis, but, in accordance with the invention, also in a radial direction. Due to the compressive force active in the radial direction, an additional clamping connection is provided between the screw nut and the impeller wheel, as a result of which an essentially more reliable mounting of the impeller wheel is enabled.

The surface segments of the hub and the nut which face one another can thus be pressed against one another when the nut is screwed onto the drive shaft such that a particularly high surface pressure is achieved between the surface segments, so that the connection between the impeller wheel and the nut is implemented in a self-locking fashion.

In particular, with high temperatures during the operation of the cooking device, with the fan apparatus according to the invention, a more secure connection is thus enabled without additional components, thereby reliably preventing an unintended detachment of the impeller wheel.

Within the scope of an advantageous development of the present invention, a flange arranged approximately coaxially to the drive shaft is molded and/or provided as a surface segment on the hub. On the impeller wheel in the region of the hub, this flange can be formed for instance as a bending or suchlike which is oriented in the axial direction. Other constructive embodiments of the surface segment are however also conceivable.

The diameter of the flange can preferably reduce in the direction of the free end of the drive shaft. In this way a flange following an approximately cone-shape in the cross-section can be provided. When screwing the nut onto the drive shaft, a surface pressure between the nut and the impeller wheel which increases with each rotation of the nut is realized as a result of the inclined conical surface.

According to an advantageous development, the conical flange can preferably comprise an angle of inclination a in respect of the axis of rotation of the drive shaft of approximately 5° to 10°. It has been shown that a particularly secure connection is achieved if the angle of inclination a is approximately 7°.

To facilitate the assembly of the impeller wheel on the drive shaft, provision can be made in accordance with a next embodiment of the present invention for the free end of the flange to comprises a region with a constant diameter. This quasi cylindrical segment preferably on the end of the flange can simplify the threading of the impeller wheel onto the drive shaft, without any tilting of the impeller wheel occurring.

It is particularly advantageous if, with the fan apparatus according to the invention, the inner segment of the nut is likewise embodied in a conical fashion in order to fasten the impeller wheel to the drive shaft in a, i.e. in the cross-sectional form of a truncated cone. The diameter of the inner segment should preferably enlarge in the direction of the impeller wheel. While screwing the nut onto the drive shaft, an optimum surface pressure should result in this way as a result of the conical surfaces which are inclined toward one another. When screwing the nut, these surface segments can tension like wedges, so that a more secure connection is realized even at high temperatures of the relevant components.

BRIEF DESCRIPTION OF DRAWINGS

The present invention is described in more detail below with reference to the drawing, in which.

DETAILED DESCRIPTION

Figure 1:
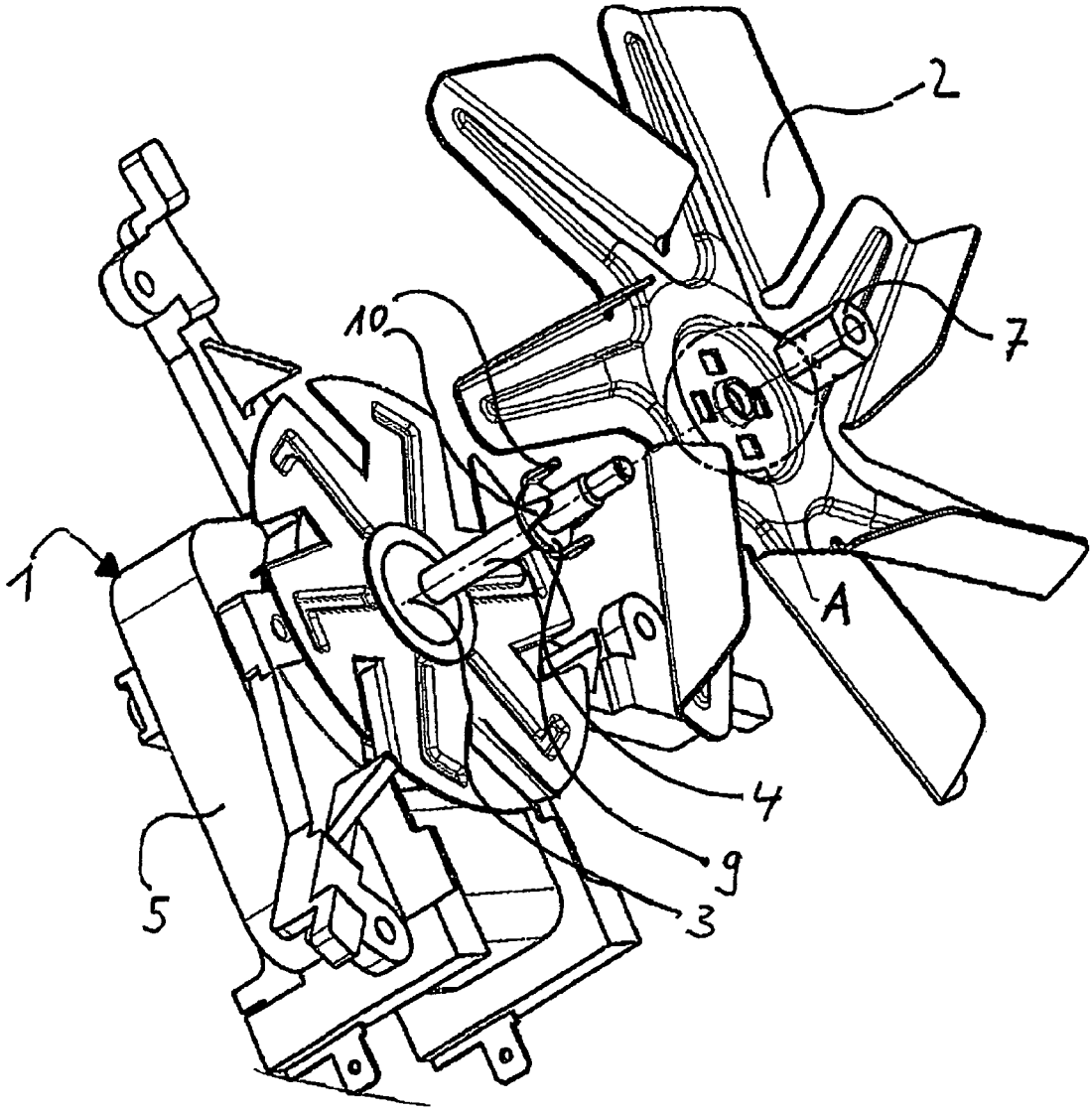
FIG. 1 shows an exploded view of a possible embodiment of a fan apparatus according to the invention

FIG. 1 shows a possible embodiment of a fan apparatus 1 according to the invention 1. The fan apparatus 1 includes an impeller wheel 2 and a rotary drive 5 in the form of an electric motor. The impeller wheel 2 is driven by way of a drive shaft 4 of the rotary drive 5 which defines a rotary axis 3.

Figure 3:
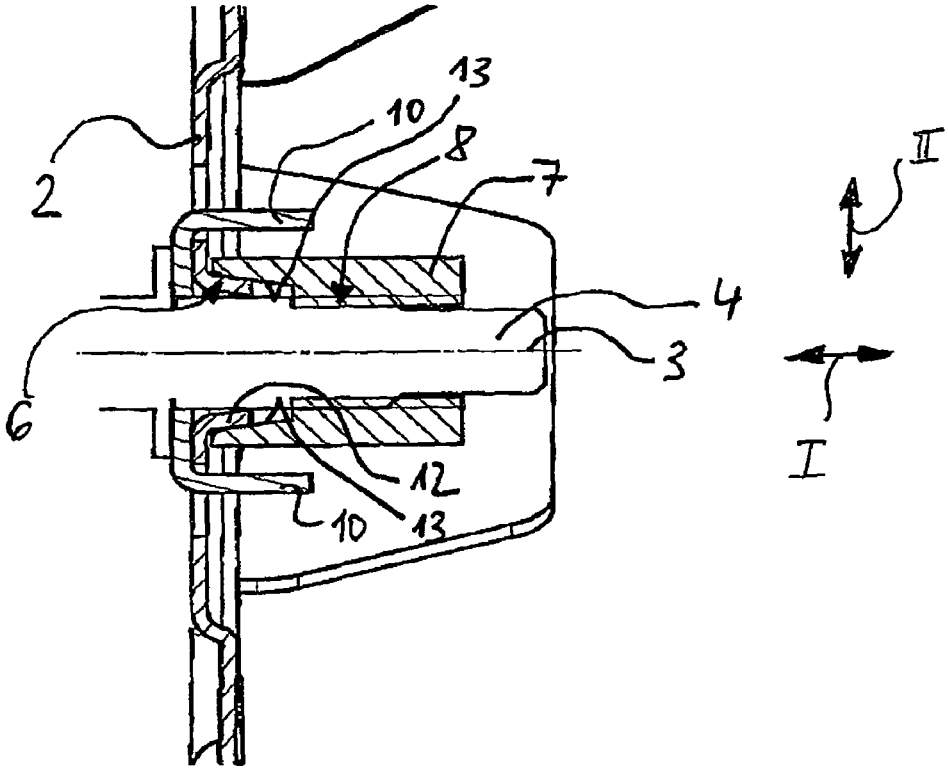
FIG. 3 shows an enlarged sectional view of the hub region of an impeller wheel of the fan apparatus according to the invention and FIG. 4 shows a cutout partial view of the hub region with a further possible embodiment.

The impeller wheel 2 has a hub 6, by way of which it is connected to the drive shaft 4 of the rotary drive 5, with a nut 7 for fastening the impeller wheel 2 being screwed onto a thread 8 on the free end of the drive shaft 4, as can be seen in particular from FIG. 3. As a result, the impeller wheel 2 is pressed in the axial direction against a fixed attachment 9 fastened to the drive shaft 4. The attachment 9 has several protrusions 10 arranged in a distributed fashion over the periphery, with these protrusions engaging in corresponding recesses 11 on the impeller wheel 2.

Figure 2:
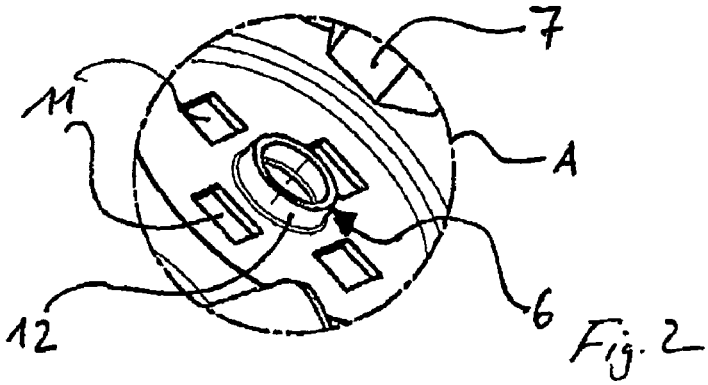
FIG. 2 shows an enlarged view of a detail A in accordance with FIG. 1

In accordance with the invention, a conical flange 12 which runs approximately coaxially to the drive shaft 4 and tapers somewhat in the axial direction is provided, as can be seen in particular from FIG. 2. The flange 12 forms a surface segment, which is assigned to an inner surface segment 13 of the nut 7, as is shown in more detail in FIG. 3.

The conical flange 12 on the hub 6 of the impeller wheel 2 has a varying diameter, with the diameter reducing in the direction of the free end of the drive shaft 4. The length of the flange 12 can amount to 2 mm in the axial direction for instance. Other dimensions are however also conceivable. The conical flange 12 preferably comprises an angle of inclination a in respect of the axis of rotation 3 of the drive shaft 4 between approximately 5° to 10°, in particular 7°.

The inner surface segment 13 of the nut 7 is likewise embodied in a somewhat conical fashion, with the diameter of the inner surface segment 13 enlarging however in the direction of the impeller wheel 2. FIG. 3 shows the installed state of the impeller wheel 2, in which the impeller wheel 2 is fixedly screwed to the drive shaft 4 with the nut 7. This illustration shows that the inner surface segment 13 of the nut 7 and the assigned surface segment of the conical flange 12 on the hub 6 of the impeller wheel 2 press against one another so that a high surface pressure between the surface segments in realized. In this way, a particularly secure connection between the impeller wheel 2 and the drive shaft 4 can be realized with the fan facility 1 according to the invention.

Figure 4:
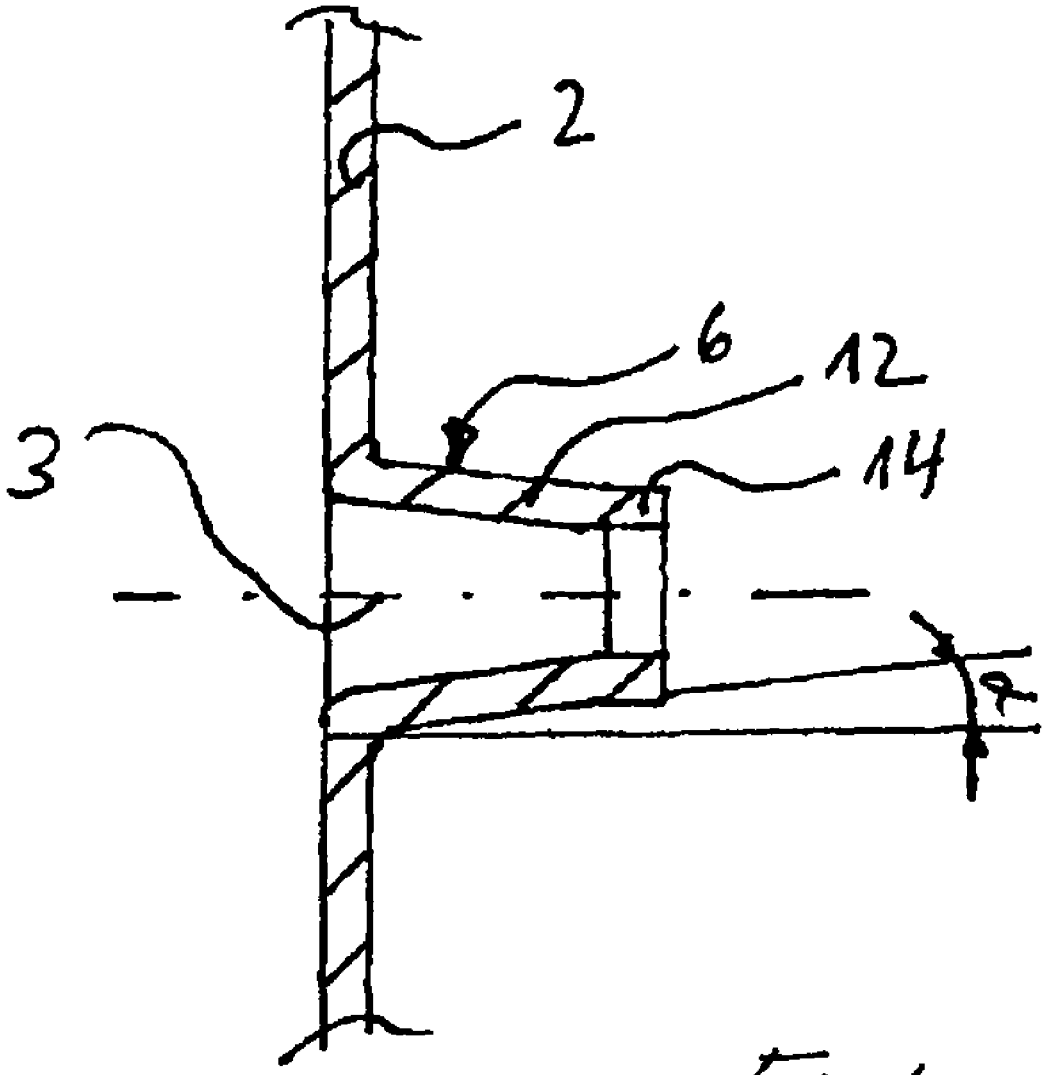

FIG. 4 shows an enlarged partial view of the hub 6 of the impeller wheel 2 with the molded flange 12. This illustration shows the modular tapering flange 12, the angle of inclination a of which in respect of the rotary axis 3 of the drive shaft amounts to approximately 7°, with the angle of inclination a being indicated by arrows in FIG. 4. In this embodiment, the free end of the conical flange 12 comprises a region 14 with a constant diameter, so that the free end of the flange 14 is embodied cylindrically. This allows the impeller wheel 2 to be assembled in a simpler fashion on the drive shaft 4, without possibly running the risk of tilting being able to occur when the impeller wheel 2 is mounted.

REFERENCE CHARACTERS

1 Fan apparatus
2 Impeller wheel
3 Rotary axis
4 Drive shaft
5 Rotary drive
6 Hub
7 Nut
8 Thread
9 Attachment
10 Protrusions
11 Recesses
12 Flange
13 Interior surface segment
14 Region with a constant diameter

The invention claimed is:

1. A fan apparatus for a cooking device, the fan apparatus comprising:

an impeller wheel that is securable on a drive shaft of a rotary drive, the impeller wheel having a hub delimiting a bore for receiving therethrough a drive shaft of a rotary drive such that the hub of the impeller wheel has, in an installed position of the impeller wheel, a drive shaft of a rotary drive extending therethrough with a stop on the drive shaft of a rotary drive preventing movement of the impeller wheel along the drive shaft in one axial direction beyond a first predetermined axial location on the drive shaft; and means for exerting a radially inward force on the hub of the impeller, at least one of the hub and the means for exerting a radially inward force being securable to a drive shaft of a rotary drive to prevent movement of the impeller wheel along the drive shaft in an axial direction opposite to the one axial direction beyond a second predetermined axial location on the drive shaft.

2. The fan apparatus as claimed in claim 1, wherein the means for exerting a radially inward force presses against an outer surface of the hub in order to exert a pressing force in the radial direction.

3. The fan apparatus as claimed in claim 2, wherein the means for exerting a radially inward force is formed with an interior surface segment, which presses against an exterior surface of the hub.

4. The fan apparatus as claimed in claim 2, wherein the exterior of the hub is configured as a truncated cone.

5. The fan apparatus as claimed in claim 4, wherein an angle of inclination of approximately 5° to 10° is enclosed between the exterior of the truncated cone hub and a rotary axis of the drive shaft.

6. The fan apparatus as claimed in claim 1, wherein a free end of the hub includes a cylinder segment.

7. The fan apparatus as claimed in claim 4, wherein an interior surface segment of the means for exerting a radially inward force has a conical shape compatibly configured with respect to the truncated cone hub.

8. The fan apparatus as claimed in claim 5, wherein the angle of inclination is 7°.

9. The fan apparatus as claimed in claim 1, wherein the means for exerting includes a threaded nut engageable with threads located on the drive shaft.

10. A fan apparatus having an impeller wheel, which is held on a drive shaft of a rotary drive by means of its hub and is pressed against a stop of the drive shaft in an axial direction by a screw nut having a threaded portion to engage with a corresponding threaded portion on the drive shaft, the screw nut having a ramped section adjacent the threaded section and oriented towards the fan impeller to exert a pressing force on the fan impeller in a radial direction.

11. The fan apparatus as claimed in claim 10, wherein the screw nut presses against an outer surface of the hub in order to exert a pressing force in the radial direction.

12. The fan apparatus as claimed in claim 10, wherein the screw nut is formed with an interior surface segment, which presses against the exterior surface on the hub.

13. The fan apparatus as claimed in claim 10, wherein the hub is embodied on the exterior in the manner of a truncated cone.

14. The fan apparatus as claimed in claim 13, wherein in an angle of inclination (a) of approximately 5° to 10°, is enclosed between the exterior of the truncated cone hub and a rotary axis of the drive shaft.

15. The fan apparatus as claimed in claim 14, wherein the angle of the inclination is 7°.

16. The fan apparatus as claimed in claim 13, wherein the free end of the hub comprises a cylinder segment adjacent the truncated cone.

17. The fan apparatus as claimed in claim 12, wherein the interior surface segment of the nut is embodied in a conical fashion in accordance with the hub.

18. The fan apparatus as claimed in claim 10, wherein the hub includes a flange having a diameter that varies and is pre-formed to reduce in diameter in a direction of a free end of the drive shaft.

19. A cooking device comprising:

a cooking chamber; and the fan apparatus of claim 10 to distribute heat equally in the cooking chamber.

* * * * *